United States Patent [19]

Stange

[11] 4,050,751

[45] Sept. 27, 1977

[54] DOCUMENT CAROUSEL

[75] Inventor: Klaus K. Stange, Pittsford, N.Y.

[73] Assignee: Xerox Corporation, Stamford, Conn.

[21] Appl. No.: 665,826

[22] Filed: Mar. 11, 1976

[51] Int. Cl.[2] ..... A47F 1/00; B65H 5/22

[52] U.S. Cl. ..... 312/197; 312/59; 312/97.1; 271/3; 271/64

[58] Field of Search ..... 312/197, 59, 97.1; 302/2 R; 271/173, 64, 3, DIG. 9, 9, 97, 195; 221/278

[56] References Cited

U.S. PATENT DOCUMENTS

| | | | |
|---|---|---|---|
| 603,316 | 5/1898 | Bush | 312/39 |
| 2,993,737 | 7/1961 | Stephen | 302/2 R |
| 3,040,727 | 6/1962 | Edwards et al. | 221/278 |
| 3,096,089 | 7/1963 | Swenker et al. | 271/173 |
| 3,119,394 | 1/1964 | Knittel | 312/59 |
| 3,334,785 | 8/1967 | Grabowski et al. | 360/88 X |
| 3,334,950 | 8/1967 | Brownlee | 312/97.1 |
| 3,406,382 | 10/1968 | Wilmer | 271/9 X |
| 3,649,081 | 3/1972 | Johnson et al. | 302/2 R |
| 3,685,671 | 8/1972 | Layman | 302/2 R |
| 3,747,754 | 7/1973 | Nix et al. | 312/59 |

*Primary Examiner*—Paul R. Gilliam
*Assistant Examiner*—Victor N. Sakran
*Attorney, Agent, or Firm*—Carlos Nieves; James J. Ralabate

[57] ABSTRACT

Apparatus for storing documents includes a carousel having a number of pockets and a structure for covering the pockets, the structure having a pair of openings through which documents may be moved into or out of the pockets. A drive is available for separately aligning the pockets with the openings. One opening is vertically oriented and fluid streams are generated for moving documents, through the opening, into or out of pockets. The other opening is horizontally disposed so that documents can be dropped into pockets. Stored documents may be blown out of pockets through the horizontal opening.

10 Claims, 4 Drawing Figures

DOCUMENT CAROUSEL

The subject invention generally relates to apparatus for storing and feeding documents, such as disclosed in copending U.S. patent application Ser. No. 638,548, A Document Storage Rack, filed on Dec. 8, 1975, on an invention by Klaus K. Stange et al, the application being assigned to the assignee herein, Xerox Corporation.

The public is aware of apparatus for storing and feeding documents wherein documents are stored in a bin and drive rollers engaging the top of the stack serially discharge the documents from the bin. In such apparatus frictional forces cause the documents to rub against each other and when the documents are repeatedly subjected to such treatments images on the documents and the documents themselves deteriorate. As an alternative to such apparatus suction or fluidic means have been devised for lifting documents from the top of a stack of documents and for transporting the documents. However, since documents are frequently provided on sheets of porous paper these devices tend to pick up more than one document at a time and this interferes with serial feeding which is frequently desired.

It is an object of the present invention to provide apparatus for separately storing documents and for serially delivering the documents.

It is another object of the present invention to provide apparatus for storing documents and for fluidically discharging stored documents.

Still another object of the present invention is to provide storage apparatus wherein documents are fluidically drawn into a carousel for storage and wherein said documents are fluidically discharged as desired.

Briefly, the invention disclosed herein for storing documents includes: (a) a carousel having a number of pockets; (b) a structure for covering the pockets, said structure having an opening; (c) drive means for rotating the carousel with respect to the structure, whereby said pockets may be aligned with the opening; and (d) fluidic means for moving documents stored in said pockets through said opening.

Additional objects and features of the invention will become apparent by reference to the following description in conjunction with the accompanying drawings, in which.

Figure 1:
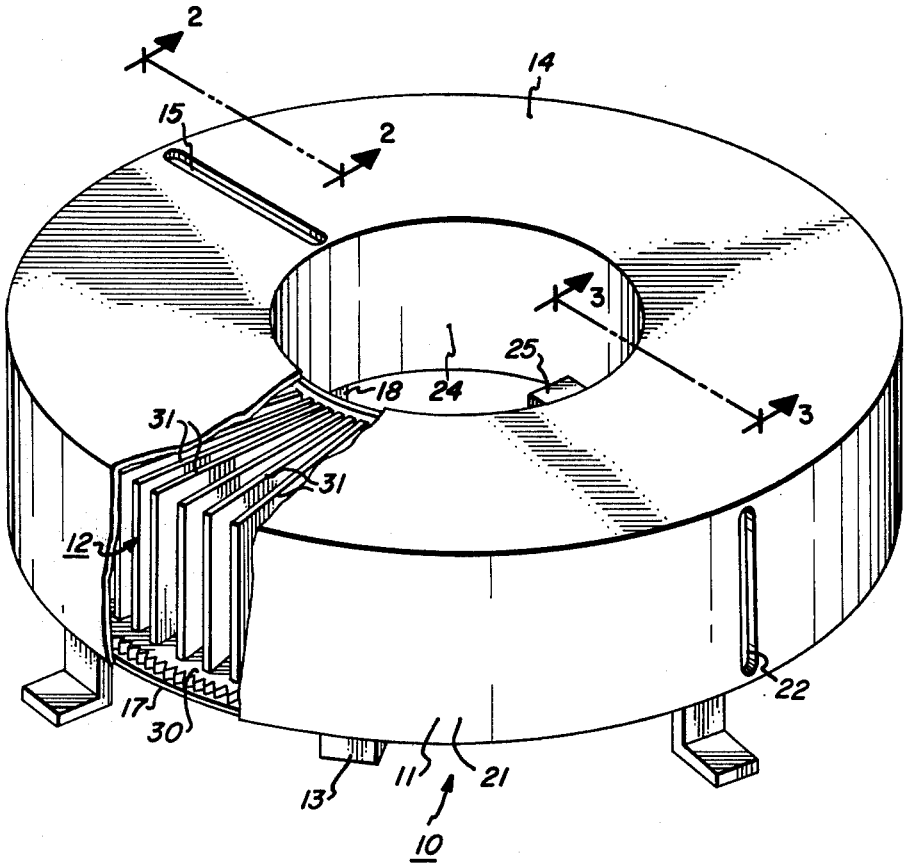
FIG. 1 is a perspective view of apparatus for storing documents, according to the invention, a section having been removed to disclose a carousel member.
Figure 2:
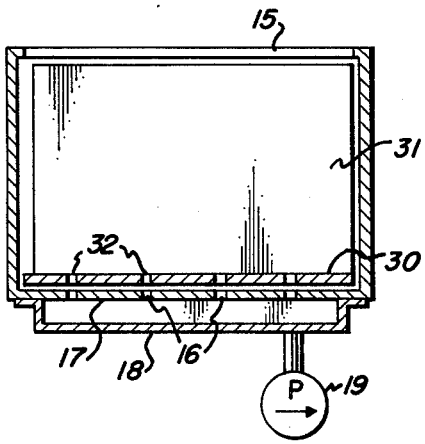
FIG. 2 is a partial cross-sectional view of the storage apparatus, the view having been taken along lines 2—2 in FIG. 1.
Figure 3:
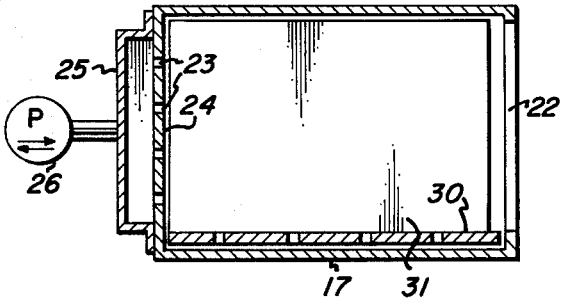
FIG. 3 is a partial cross-sectional view of the storage apparatus, the view having been taken along lines 3—3 in FIG. 1.

Referring to FIGS. 1 and 2, apparatus for storing documents 10, according to the invention, includes a horizontally disposed torus structure 11, of rectangular cross section, within which there is rotatably mounted a carousel 12 and means 13 for rotating the carousel. The top wall 14 of structure 11 includes a radially extending elongated opening 15 which is vertically aligned with a radially oriented series of holes 16 (see FIG. 2) located on the bottom wall 17 of structure 11. Holes 16 communicate with the inside of the structure and with the chamber of a manifold 18 coupled to the structure. Manifold 18 is coupled to a fluid pump 19 which, as will be explained below, cooperates with the holes and manifold to provide a fluid stream for discharging through the opening documents stored in the carousel. The outer cylindrical wall 21 of the structure includes a vertically extending opening or slot 22 radially aligned with a vertically oriented bunch of holes 23 (see FIG. 3) located on the inner cylindrical wall 24 of the structure. Holes 23 communicate with the inside of the structure and with the chamber of a manifold 25 coupled to the structure. Manifold 25 is coupled to a reversible fluid pump 26 which, as will appear, cooperates with holes 23 and manifold 25 to provide a fluid stream for discharging documents in the carousel through the opening 22 or for drawing documents inserted through opening 22 into the carousel 12.

Figure 4:
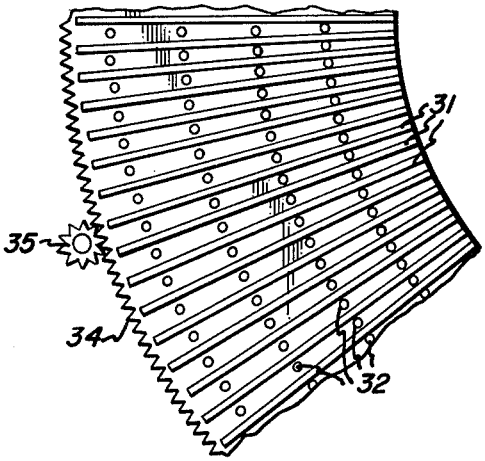
FIG. 4 is a partial top plan view of the carousel member of the apparatus.

Carousel 12 includes a flat annular member 30 journaled to the structure for rotation immediately above bottom wall 17 and a plurality of spaced plates 31. Plates 31 are perpendicularly secured to the member and are radially disposed, the angular distance between any two adjacent plates being the same. As may be seen in FIG. 2 or 3, the plates are in near contact with walls 14, 21, and 24. Referring to FIG. 4, between each adjacent pair of plates there is located in the member 30 a set of radially disposed holes 32 which may be aligned with the series of holes 16. Therefore, it will be appreciated that if a document is located in a pocket, defined by a pair of adjacent plates and the member, and if a set of holes communicating with that pocket is aligned with the series of holes 16 a blast of air provided by pump 19 may be used to move the document through opening 15 and out of the apparatus. The periphery of member 30 includes teeth 34 which are engaged by a gear 35 coupled (not shown) to drive 13, which includes a motor. While selective activation of the motor may be used to align any one of the sets of holes with the series of holes, it will be appreciated by persons skilled in the servomechanism art that position sensors may be used to align any one of the sets of holes with the series of holes with a minimum amount of hunting and that the carousel can be stepped along to serially align the sets of holes for moments of time with the series of holes. Therefore, it will be appreciated that documents located in any or all of the carousel pockets may be discharged through opening 15. Alternatively, with pump 19 off, documents may be dropped through opening 15 into pockets of the carousel for storage.

Carousel 12 may be rotated such that its pockets are brought into alignment with opening 22 and holes 23. Therefore, a fluid stream generated by pump 26 may be used to discharge documents in any of the pockets or, if pump 26 is operated in a vacuum mode, a fluid stream may be used to draw documents inserted through opening 22 into pockets. In the subject embodiment a pocket is aligned with opening 22 and holes 23 when the series of holes 16 is aligned with one of the sets of holes. Therefore, if desired, documents may be moved into or out of the carousel through openings 15 and 22 simultaneously.

The apparatus shown may be modified in many ways without deviating from the spirit of the invention. For example, apparatus may be provided wherein pump 26, manifold 25, holes 23 and opening 22 is missing or is replaced with an arrangement similar to pump 19, manifold 18, holes 16 and opening 15 may be removed or replaced with an arrangement such as pump 26, manifold 25 holes 23 and opening 22. Accordingly, it is to be understood that the description herein of a preferred embodiment, according to the invention, has been set forth as an example thereof and is not to be construed or interpreted to provide limitations on the claims which follow and define the invention.

What is claimed is:

1. Apparatus for storing documents, comprising:

a. a carousel having a number of pockets;

b. a structure for covering the pockets, said structure having an opening;

c. drive means for rotating the carousel with respect to the structure, whereby said pockets may be aligned with the opening; and d. fluidic means for moving documents stored in said pockets through said opening.

2. Apparatus as defined in claim 1 wherein said carousel includes a circular member and a plurality of spaced plates transversely supported by the member, said plates extending away from the axis of the member and each of said pockets being defined by at least two different adjacent plates and the member.

3. Apparatus as defined in claim 2 wherein said fluidic means include at least one hole, located in the structure, aligned with the opening; a number of sets of holes located in the member, each set communicating with a different one of the pockets and being disposed for movement into alignment with said at least one hole by the drive means; and means for injecting fluid through said at least one hole and through a set of aligned holes, whereby fluid flows through a pocket and said opening.

4. Apparatus as defined in claim 3 wherein said means for injecting fluid includes a manifold coupled to the structure with its chamber in communication with said at least one hole and a fluid pump coupled to the manifold.

5. Apparatus as defined in claim 3 wherein said opening is vertically aligned above said at least one hole.

6. Apparatus as defined in claim 1 wherein said fluidic means also performs the function of moving documents inserted into the opening into said pockets.

7. Apparatus as defined in claim 6 wherein said carousel includes a circular member and a plurality of spaced plates transversely supported by the member, said plates extending away from the axis of the member and each of said pockets being defined by at least two different adjacent plates and the member.

8. Apparatus as defined in claim 7 wherein said fluidic means include one or more holes, located in the structure in alignment with the opening; and means for injecting or drawing fluid through said one or more holes, whereby fluid flows through a pocket and said opening.

9. Apparatus as defined in claim 8 wherein said means for injecting or drawing fluid includes a manifold coupled to the structure with its chamber in communication with said one or more holes and a reversible fluid pump coupled to the manifold.

10. Apparatus as defined in claim 8 wherein said member is horizontally disposed, and wherein said opening is a vertically disposed elongated slot.

* * * * *